United States Patent [19]

Purdie

[11] Patent Number: 4,998,959

[45] Date of Patent: Mar. 12, 1991

[54] MUTE FOR HORN-TYPE INSTRUMENTS

[76] Inventor: Thomas Purdie, 336 21st St., Room 132, Miami Beach, Fla. 33139

[21] Appl. No.: 555,113

[22] Filed: Jul. 19, 1990

[51] Int. Cl.[5] ..... G10D 9/06

[52] U.S. Cl. ..... 84/400; 84/453

[58] Field of Search ..... 84/400, 453

[56] References Cited

U.S. PATENT DOCUMENTS

| | | | |
|---|---|---|---|
| D. 69,112 | 12/1925 | Buskey . | |
| 1,508,024 | 9/1924 | McArthur | 84/400 |
| 1,644,272 | 10/1927 | Pinard | 84/400 |
| 1,741,835 | 12/1929 | Gantner | 84/400 |
| 2,657,609 | 11/1953 | Strobach | 84/453 |
| 3,016,782 | 1/1962 | Laas | 84/453 |
| 3,099,183 | 7/1963 | Alles | 84/400 |
| 3,299,764 | 1/1967 | Ventura | 84/400 |
| 3,429,215 | 2/1969 | Finch | 84/400 |
| 3,760,679 | 9/1973 | Gossick et al. | 84/400 |
| 4,012,983 | 3/1977 | Ploeger | 84/400 |
| 4,632,003 | 12/1986 | Kopp | 84/1.16 |

FOREIGN PATENT DOCUMENTS

| | | | |
|---|---|---|---|
| 549398 | 2/1923 | France | 84/400 |

OTHER PUBLICATIONS

"The Music Trade" of Jun. 21, 1924, pp. 25–26.

*Primary Examiner*—Lawrence R. Franklin

*Attorney, Agent, or Firm*—McDermott, Will & Emery

[57] ABSTRACT

A mute for a horn-type musical instrument is disclosed. The mute comprises a resonating dish which has an opening therein to permit air flow through the dish and a slit extending from the opening to facilitate resonance of the dish. The dish is adapted to fit over the outside of the bell of the instrument on the bell wire by adjustable fitting means. The mute changes the timbre of the sound generated by the instrument, yet maintains the majority of the volume of sound prior to placement of the mute onto the bell.

11 Claims, 7 Drawing Sheets

MUTE FOR HORN-TYPE INSTRUMENTS

BACKGROUND OF THE INVENTION

The invention of this application relates to a mute for use with horn-type instruments. More particularly, this invention relates to a mute which changes the timbre of the sound generated by horn-type instruments yet maintains the majority of the presence or volume of the sound present prior to the placement of the mute onto the instrument.

A mute is a device that deadens, dampens or changes the color of the sound generated by a musical instrument such as a horn instrument. Typically, a mute is either fit into the bell of the instrument by means of corks that stick to the inside of the bell or can be clipped around the bell. Alternatively, the player of the instrument may play into a reflective or absorbent material set on a stand in order to achieve a muting effect.

The use of mutes stems from brass instrument players using their hands in the bell of the instrument to help change the pitch of the instrument. Since early brass instruments had no valves, and had a limited number of pitches available, using the hand in the bell could change the pitch. However, the hand was not used to change the color of the sound. Not until the 1830's when Berlioz actually indicated the use of mutes in the music did such use specifically change the color of the sound. Mutes used for such purpose were primarily wooden cone-shaped devices that were either held in the bell or had corks that stuck them in the bell.

In the 1920's, mutes were first used to radically alter the timbre of the sound. Typical of such mutes was the standard wooden cone-shaped mute commonly called a "straight mute." The French "Bol mute" or cup mute added a cup, facing back towards the bell, giving a cupped sound. The "Hamon mute" gives a metallic buzzing sound and its timbre may be adjusted by means of a moveable metal stem in the front. Other typically utilized mutes are described in U.S. Pat. Nos. 1,644,272, 1,741,835, 2,657,609, 3,016,782, 3,299,764 and 3,429,215. None of these mutes have or had a resonating body having an opening and a slit therein to permit air flow through and resonance of the mute.

Heretofore, all mutes have either deadened, dampened or changed the color or timbre of the sound of the instrument in which they are used but also greatly reduced the volume of the sound. The invention disclosed herein comprises a mute which changes the timbre of the sound generated by an instrument yet maintains the majority of the presence or volume of the sound.

SUMMARY OF THE INVENTION

The present invention contemplates a mute for a horn-type musical instrument having a bell.

In one aspect of the present invention, the mute of the invention comprises a resonating body which includes an opening therein to permit air flow through the body and a slit extending from the opening to facilitate resonance of the body.

In a further aspect of the present invention, the resonating body of the mute of the invention, which may be dish-shaped, is adapted to fit over the outside of the bell on the bell wire to thereby change the timbre of the sound generated by the instrument and maintain the majority of the sound volume.

In another aspect of the present invention, the mute further includes adjustable fitting means for retaining the mute on the bell wire. The fitting means have grooves therein to accommodate placement of the mute at different distances from the bell wire.

The present invention provides several benefits and advantages.

One benefit of the present invention is that the mute of the invention changes the timbre of the sound generated by a horn-type instrument yet maintains to a great extent the volume of the sound.

Another benefit of the present invention is that the mute of the invention is reversible, has little air resistance and has an excellent response on attacks.

One of the advantages of the present invention is that the mute of the invention comprises a resonating body instead of the sound absorbing material from which present mutes are formed.

Another advantage of the present invention is that the mute of the invention fits over the outside of the instrument bell rather than into the instrument in order to permit free play of the instrument in which it is used.

Yet another advantage of the present invention is that the mute of the invention is retained on the bell wire of the instrument by means of fittings which are adjustable to accommodate placement of the mute at different distances from the instrument bell.

Other benefits and advantages of the present invention will become readily apparent to those skilled in the art from the following detailed description of the invention, the drawings and the appended claims.

BRIEF DESCRIPTION OF THE DRAWINGS

In drawings forming a portion of the disclosure of this invention.

DETAILED DESCRIPTION OF THE INVENTION

Figure 1:
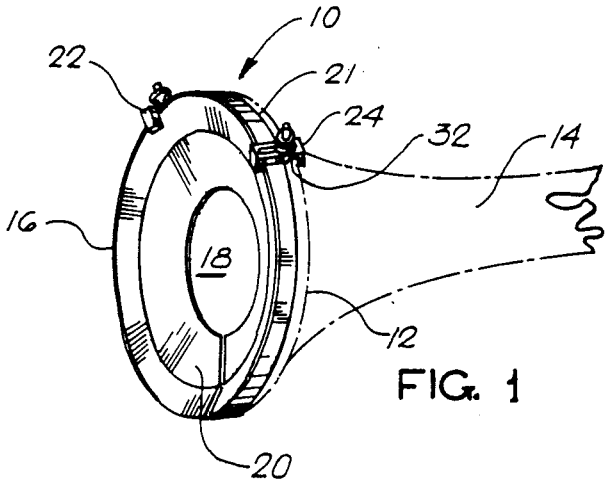
FIG. 1 is a side view of the mute of the present invention illustrating the mute being attached to a horn-type instrument.

The present invention is directed to a mute for a horn-type instrument which changes the timbre of the sound generated by the instrument yet maintains the majority of the volume of the sound present prior to placement of the mute onto the bell.

With reference to FIGS. 1–5, a preferred embodiment of the mute of the present invention is shown. Mute 10 is fitted on the bell 12 of a horn-type instrument 14, such as a trumpet. Mute 10 comprises a resonating body 16 which is preferably dish-shaped and has an opening 18 in the center thereof to permit air to flow through the body 16. Body 16 also includes a slit 20 extending perpendicularly from opening 18 to the edge of body 16 to facilitate resonance of body 16 by Permitting freer air flow through body 16 than if slit 20 were not present.

Body 16 is adapted to fit over the outside or bell-wire 21 of bell 12 in a free-hanging manner in order to change the timbre of the sound generated by instrument 14 and to maintain the majority of the volume of such sound prior to placement of the body 16 onto the bell 12. Body 16 may be flat, convex or concave. The body 16 may be fabricated of wood, metal or any highly resonant plastic material. If plastic is used, dish 16 is formed by molding processes well known in the art. The preferred material for body 16 is a highly resonant wood. Exemplary of such wood is a rosewood known as "coco bolo." If coco bolo is used, the body 16 may be finished, if desired, with a suitable varnish or shellac, as is well known in the art. If metal is to be used, brass is preferred. The body 16 may be of varying width depending upon the instrument on which it is to be used.

Slit 20 may be cut in mute 10 either with or against the grain of the wood, if wood is used for fabrication of mute 10. It is preferred that slit 20 be cut against the grain so that the maximum strength of the wood is maintained. If a plastic material is used for fabrication of body 16, slit 20 would be in the mold used and, therefore, not cut into mute 10.

Figure 6:
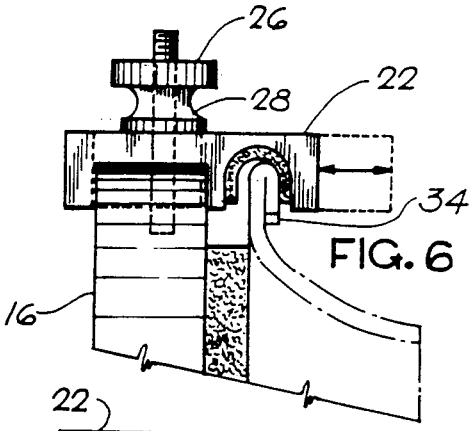
FIG. 6 is a side view of the adjustable fitting means of the mute of the present invention.
Figure 7:
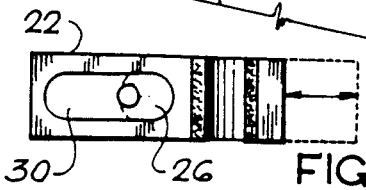
FIG. 7 is a top view of the adjustable fitting means of the mute of the present invention.

With reference to FIGS. 6 and 7, body 16 is fitted on bell 12 by felt-lined, adjustable fitting means 22, 24 which retain body 16 on bell wire 21 of bell 12. Fitting means 22, 24 are adjustable for different lengths of body 16 from bell 12, not for sound color purposes, but to permit tuning for maximum resonance.

Adjustable fitting means 22, 24 comprise set screws 26, 27 and fittings 28, 29 which are preferably made of brass. Fittings 28, 29 may be made of plastic material, if desired, to minimize buzzing of the fittings on the bell wire 21. Set screws 26, 27 are moveable in grooves 30, 32 of the fittings in order to accommodate placement of the mute at varied distances from the bell 12 and attach mute 16 to instrument 14. Once the desired positioning of mute 10 on bell wire 21 is achieved, set screws 26, 27 are tightened to retain mute 10 in the desired position. Additionally, fitting means 22, 24 are slidably reversible to permit use of mute 10 on either its concave or convex side. Alternatively, fitting means may be positioned at the 12, 3 and 9 o'clock positions, if body 16 is dish-shaped. In such a configuration, the fitting means at the 3 and 9 o'clock positions of the body 16 are adjustable to accommodate different bell diameters. The fitting means at the 12 o'clock Position would not be adjustable.

Figure 2:
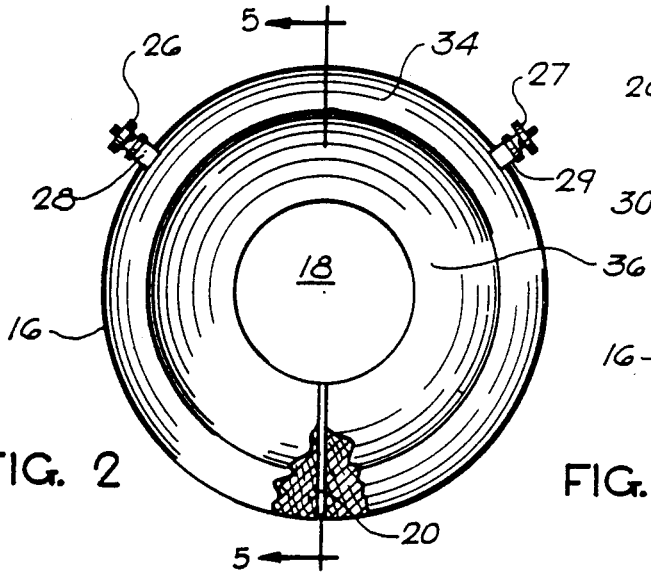
FIG. 2 is a front view of the mute of the present invention.
Figure 4:
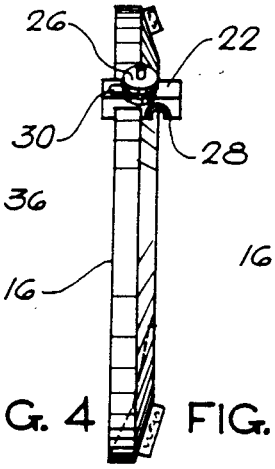
FIG. 4 is a side view of the mute of the present invention.
Figure 5:
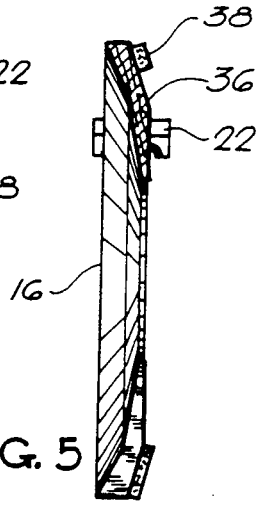
FIG. 5 is a cross-sectional view of the mute of FIG. 2.
Figure 3:
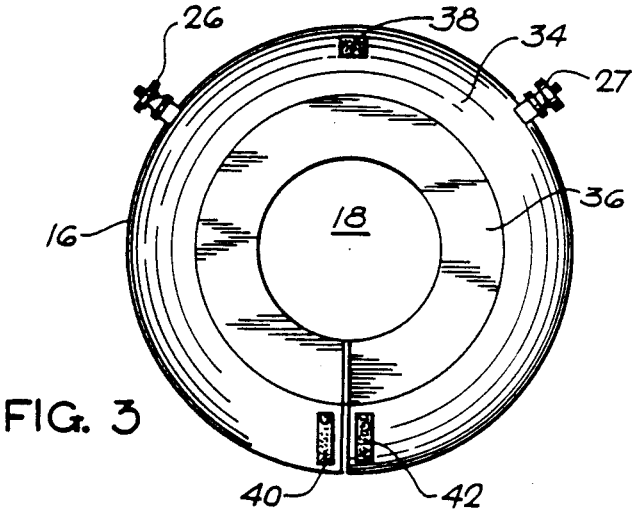
FIG. 3 is a back view of the mute of the present invention illustrating pads placed on the mute for protection purposes.

Body 16 of mute 10 may have a plurality of beveled portions 34, 36 for maximum fit and resonance. If two beveled portions are desired, as shown in FIGS. 2 and 3, beveled portions 34, 36 are angled at 18° and 36°, respectively. Alternatively, if three beveled portions are desired, they will be angled at 18°, 36° and 54°. In addition to the above-mentioned beveling, the width of mute 10 is variable as desired.

The back side of mute 10 which faces bell 12 has protective pads 38, 40, 42 attached thereto by means of glue, epoxy or other adhesives well known in the art. It is preferred that the pads be of felt material. Pads 38, 40, 42 protect against scratches of bell 12, eliminate buzzing, space mute 10 from bell 12 and eliminate the need to tighten fittings 28, 29 to bell wire 21.

Alternatively, pads may be positioned on the front of body 16, on the back thereof, on both the front and back and/or extending over the side portion of body 16 from front to back.

Since mute 10 is attached to bell 12 at the top of instrument 14 and a resonating body 16 is utilized, the mute 10 of the present invention changes the timbre of sound yet maintains the majority of the sound produced by the instrument 14. Thus, the sound can be colored without being deadened significantly.

With reference to FIGS. 8–13, the effectiveness of the mute of the present invention in changing the timbre of the sound generated by a horn-type instrument yet maintaining the majority of the volume of the sound is demonstrated.

Figure 8:
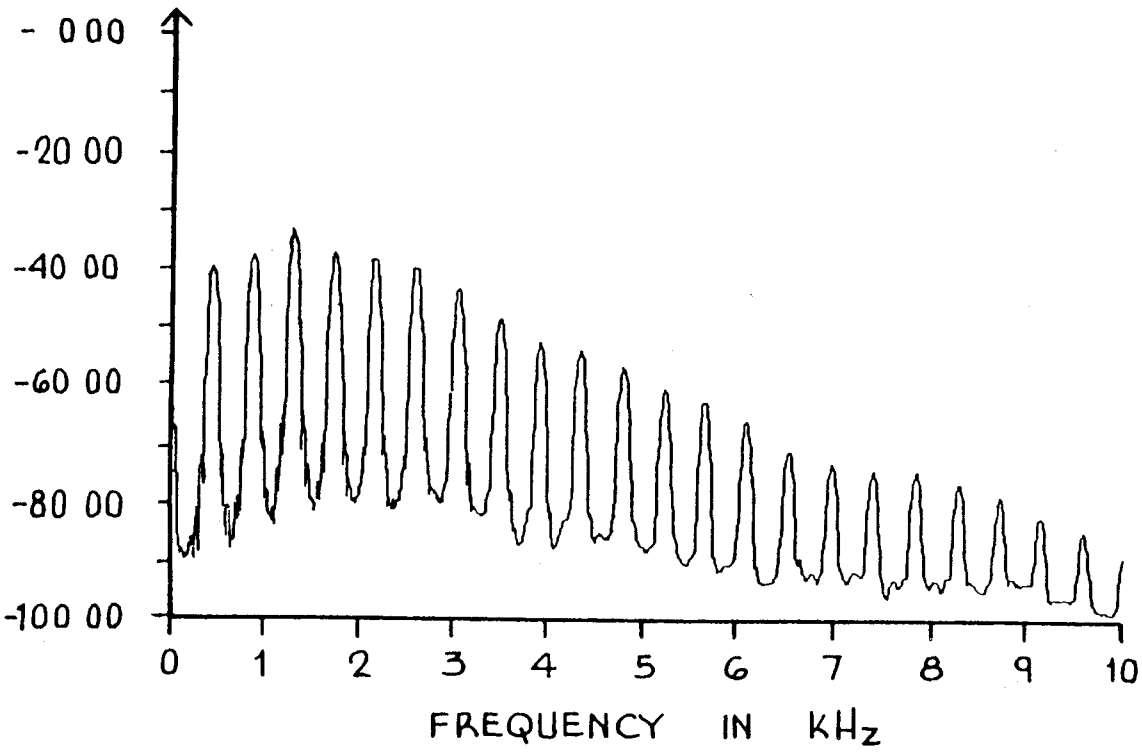
FIG. 8 is a graph illustrating the harmonic pattern of the sound generated by an open trumpet without any mute being utilized.

As shown in FIGS. 8–13, the spectral density of the sound generated by a trumpet as a function of frequency in kHz at a pitch of A440 was measured for various embodiments of the mute of the present invention and three examples of prior art mutes. For purposes of reference, FIG. 8 illustrates the harmonic pattern of the sound generated by a trumpet without any mute being inserted into or affixed to the bell of the trumpet.

Figure 9:
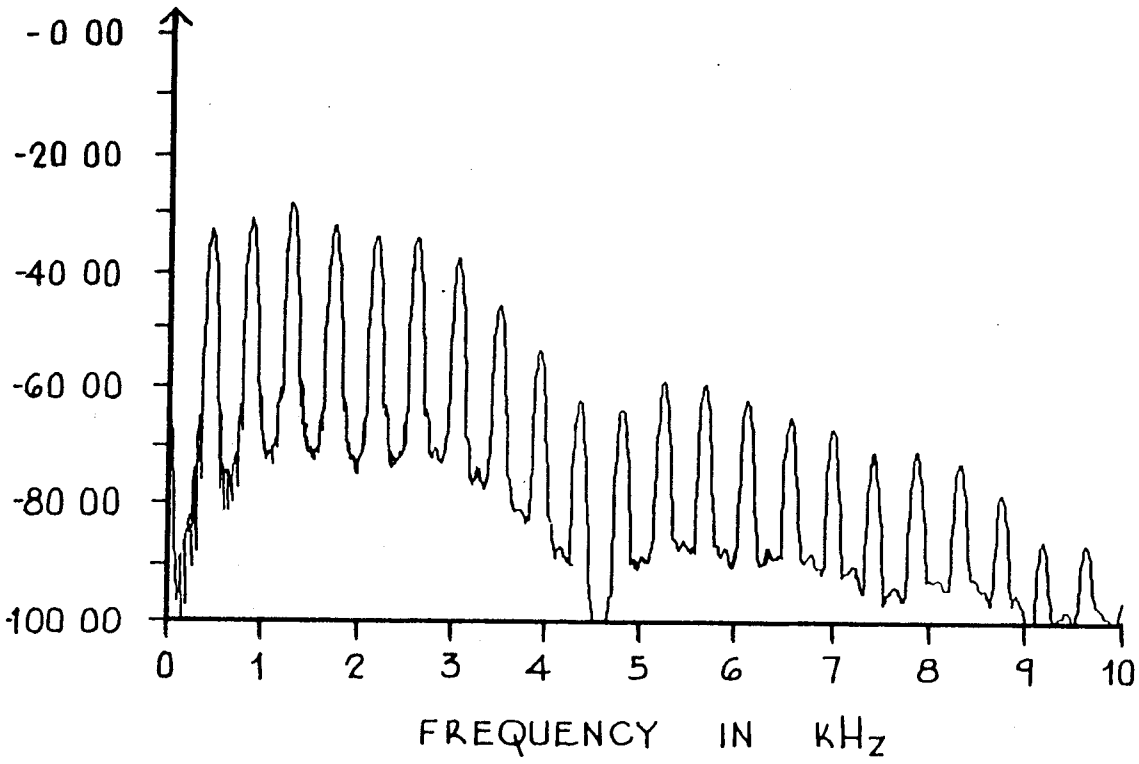
FIG. 9 is a graph illustrating the harmonic pattern of the sound generated by a trumpet having the mute of the present invention fitted on the bell of the trumpet with the convex side of the mute facing the interior of the trumpet.
Figure 10:
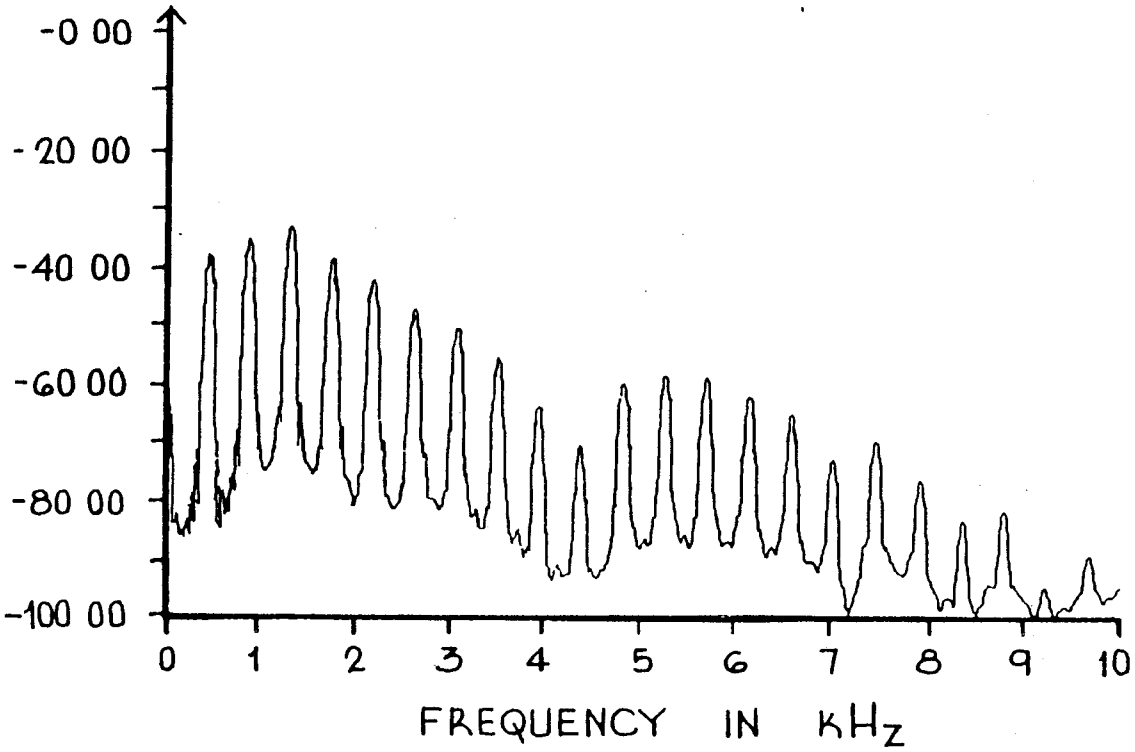
FIG. 10 is a graph illustrating the harmonic pattern of the sound generated by a trumpet having the mute of the present invention fitted on the bell of the trumpet with the concave side of the mute facing the interior of the trumpet.

With reference to FIGS. 9 and 10, two embodiments of the mute of the present invention, in convex and concave configurations, respectively, change the sound timbre or color of the sound when used with the trumpet, as reflected in the measurements at the high end of the frequency scale. However, the mutes maintain a large majority of the sound volume of the trumpet without a mute (FIG. 8), as reflected in the amplitude of the peaks at the lower end of the frequency scale.

Figure 11:
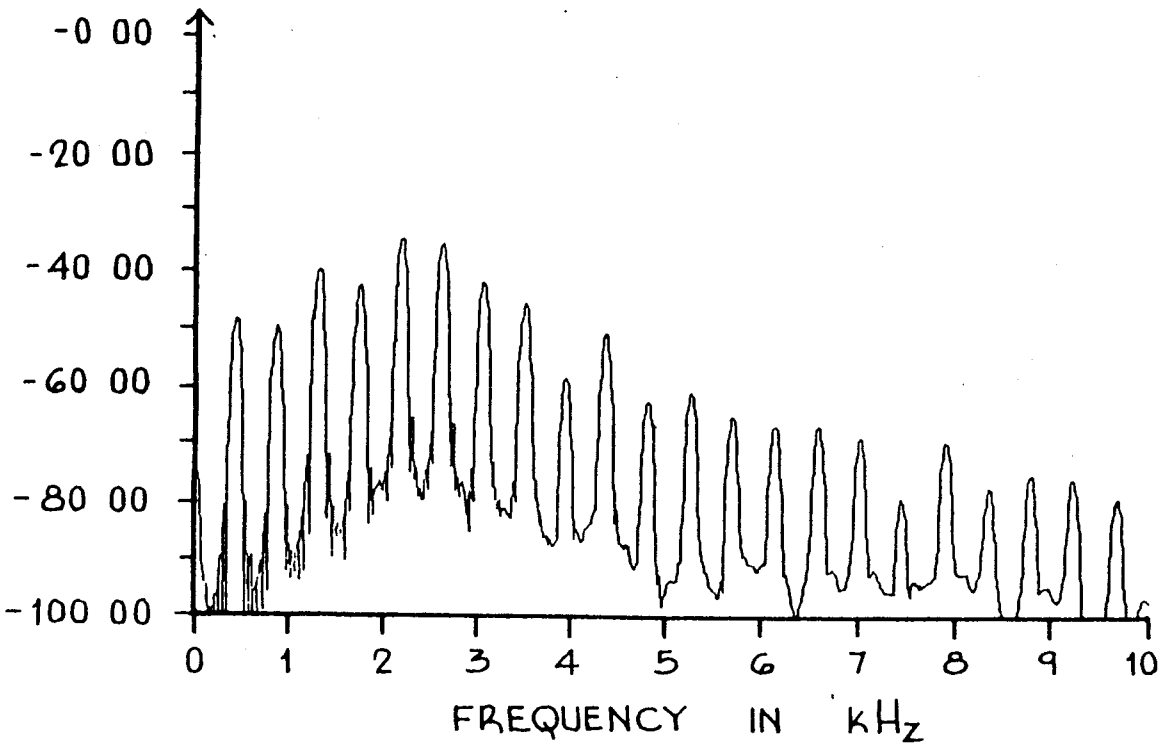
FIG. 11 is a graph illustrating the harmonic pattern of the sound generated by a trumpet having a prior art straight mute inserted therein.
Figure 12:
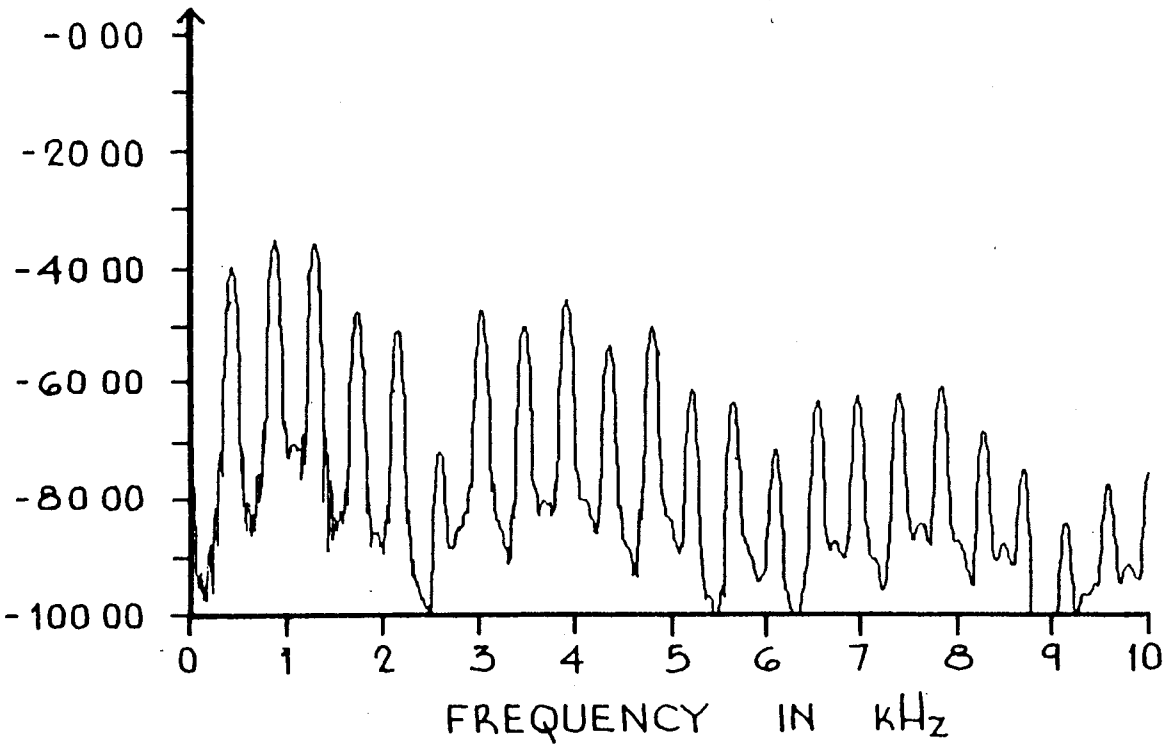
FIG. 12 is a graph illustrating the harmonic pattern of the sound generated by a trumpet having a prior art cup mute placed over the opening thereof; and, FIG. 13 is a graph illustrating the harmonic pattern of the sound generated by a trumpet having a prior art bucket mute placed over the opening thereof.
Figure 13:
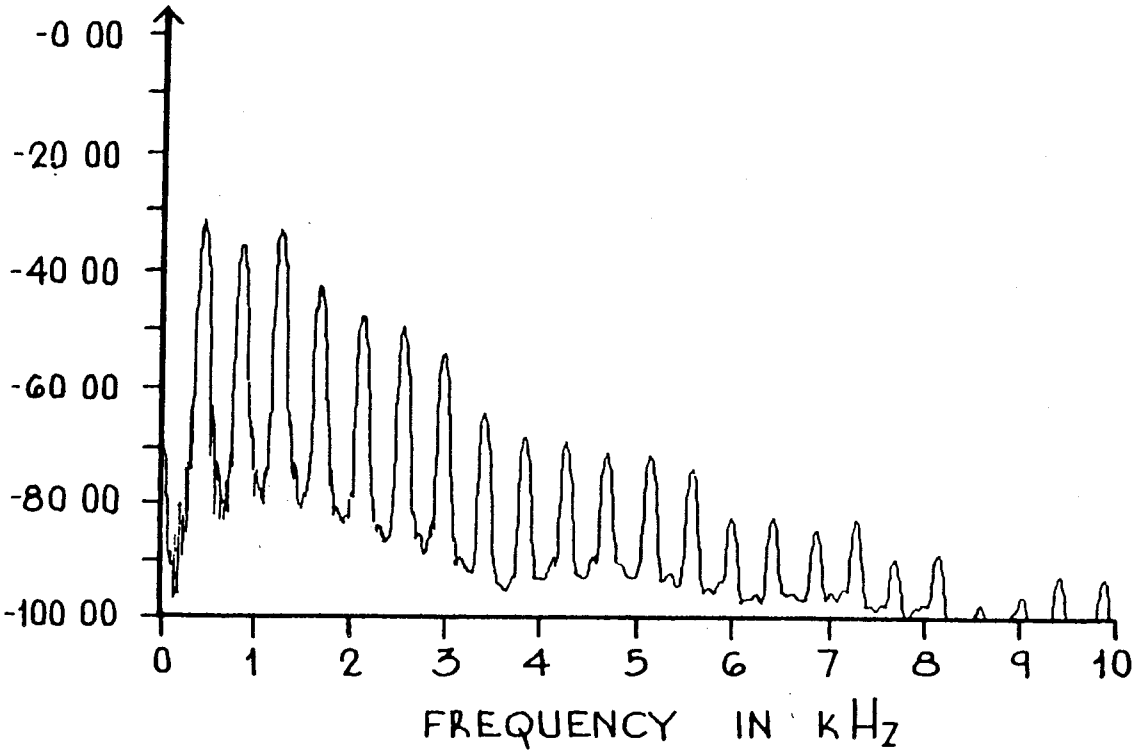

FIGS. 11–13 demonstrate that the prior art straight, cup and bucket mutes, respectively, color the sound generated by the trumpet yet reduce the volume of the sound generated by the trumpet much more significantly than does the mute of the present invention.

Thus, it is amply demonstrated that the mute of the present invention, which, unlike heretofore known mutes, comprises a freely resonating body including an opening therein to permit air flow through the body and a slit extending from the opening to facilitate resonance of the body, changes the timbre of the sound generated by a horn-type instrument yet maintains the majority of the sound volume.

The foregoing is intended as illustrative of the present invention but not limiting. Numerous variations and modifications may be effected without departing from the true spirit and scope of the invention.

What is claimed is:

1. A mute for a horn-type musical instrument having a bell comprising a freely resonating body including an opening therein to permit air flow through said body, and a slit extending from said opening to facilitate resonance of said body, said body being adapted to fit over the outside of said bell on the bell wire to thereby change the timbre of the sound generated by said instrument and maintain the majority of the volume of said sound generated prior to placement of said mute onto said bell.

2. The mute of claim 1 wherein said mute further includes adjustable fitting means for retaining said mute on said bell wire.

3. The mute of claim 2 wherein said fittings are comprised of brass.

4. The mute of claim 1 wherein said mute is comprised of wood.

5. The mute of claim 1 wherein said mute is reversible into said bell.

6. The mute of claim 1 wherein said resonating body is dish-shaped.

7. The mute of claim 6 wherein said resonating body is free hanging with respect to said bell wire.

8. The mute of claim 1 wherein said mute is flat.

9. The mute of claim 1 wherein said mute is convex.

10. The mute of claim 1 wherein said mute is concave.

11. A mute for a horn-type musical instrument having a bell comprising a wooden, concave resonating dish, said dish including an opening therein to permit air flow through said dish and a slit extending from said opening to facilitate resonance of said dish, said dish being adapted to fit over the outside of said bell on the bell wire and being retained on said bell wire by adjustable fitting means, said mute changing the timbre of the sound generated by said instrument and maintaining the majority of the volume of said sound generated prior to placement of said mute into said bell.

* * * * *